United States Patent [19]

Levrai et al.

[11] Patent Number: 4,978,820

[45] Date of Patent: Dec. 18, 1990

[54] DEVICE FOR DETECTING THE POSITION OF A MEMBER MOVABLE INSIDE A STATIONARY MEMBER

[75] Inventors: Roland Levrai, Stains; Le Normand Pascal, Aulnay sous Bois, both of France

[73] Assignee: Bendix France, Drancy, France

[21] Appl. No.: 359,072

[22] Filed: May 30, 1989

[30] Foreign Application Priority Data

Jul. 22, 1988 [FR] France ..... 88 09908

[51] Int. Cl.[5] ..... H01H 35/38

[52] U.S. Cl. ..... 200/82 D

[58] Field of Search ..... 73/118.1, 432.1, 865.8; 340/686–688; 33/DIG. 15; 116/272; 200/82 D, 82 R, 82 E, 82 C, 82 B, 82 A; 324/208

[56] References Cited

U.S. PATENT DOCUMENTS

| | | | |
|---|---|---|---|
| 1,961,004 | 5/1934 | Lemaitre et al. | 200/82 D |
| 2,386,179 | 10/1945 | Andrus | 33/DIG. 15 |
| 2,987,714 | 6/1961 | Bonner et al. | 200/82 D |
| 3,546,667 | 12/1970 | Thomas | 200/82 R |
| 3,654,549 | 4/1972 | Maurer et al. | 324/208 |
| 4,206,455 | 6/1980 | Isakson | 340/626 |
| 4,471,304 | 9/1984 | Wolf | 92/5 R |

FOREIGN PATENT DOCUMENTS

| | | | |
|---|---|---|---|
| 715369 | 12/1931 | France | 200/82 R |
| 2289781 | 5/1976 | France . | |
| 2509883 | 1/1983 | France . | |
| 1539801 | 2/1979 | United Kingdom . | |

*Primary Examiner*—Robert Raevis

*Attorney, Agent, or Firm*—Larry J. Palguta; Ken C. Decker

[57] ABSTRACT

The invention relates to a device for measuring the position of a movable member relative to a stationary member, the stationary member being one of the walls of a booster housing (14), and the movable member being a piston mechanism (16) dividing the housing into a front chamber and a rear chamber, comprising a movable first mechanism (42) which is movable together with the movable member (16) and the movement of which is detected in relation to a second mechanism (26) stationary relative to the stationary member (14). According to the invention, the stationary second mechanism (26) is fastened to the stationary member (14) outside the housing (14) of the booster, the movable first mechanism (42) sliding relative to the stationary second means (26), so as to vary at least one electrical quantity as a function of the position of the movable first mechanism (42) relative to the stationary second mechanism.

4 Claims, 2 Drawing Sheets

DEVICE FOR DETECTING THE POSITION OF A MEMBER MOVABLE INSIDE A STATIONARY MEMBER

The present invention relates to a device for detecting the position of a member movable inside a stationary member surrounding it, more particularly of a piston means of a pneumatically actuated booster.

In the motor-vehicle industry, it has become customary to assist various controls actuated by the driver of a vehicle, such as the brake, clutch or such like controls, by means of various force-amplifying devices which, for the same output force, demand only a limited force from the driver.

Such amplifying devices currently consist of pneumatic boosters comprising a housing divided into a front chamber and rear chamber by a piston means movable from a rest position near the rear wall of the housing. These pneumatic boosters function in a completely satisfactory way.

However, for reasons of safety and/or smooth functioning, it is desirable to note the state of these amplifying devices at any moment, in order to actuate an alarm signal in the event of a failure, to control other devices or to exert influence on a feedback loop.

The document FR-A-2,509,883 makes known a clutch booster possessing a recorder for measuring the position of the stroke of the booster, consisting of a conductive strip extending in the direction of this stroke and of a pickup carried by the movable rod of the booster, the conductive strip and the pickup together forming a linear potentiometer supplying a measurement signal in order to control the functioning of the booster.

In this document, the measuring recorder is incorporated in the booster housing, thus making it necessary for the latter to be of a special and relatively complex design, preventing its use on boosters of conventional design.

To overcome this disadvantage, an object of the invention is to provide a device for measuring the position of the piston means in a pneumatically actuated booster, which can be fitted on housings of boosters of a known type without any modification of these.

To achieve this, the invention provides a device for measuring the position of a movable member relative to a stationary member, the stationary member being one of the walls of a booster housing, and the movable member being a piston means dividing the housing into a front chamber and a rear chamber, comprising a movable first means which is movable together with the movable member and the movement of which is detected in relation to a second means stationary relative to the stationary member, characterized in that the stationary second means is fastened to the stationary member outside the housing of the booster, the movable first means sliding relative to the stationary second means so as to vary at least one electrical quantity as a function of the position of the movable first means relative to the stationary second means.

Figure 1:
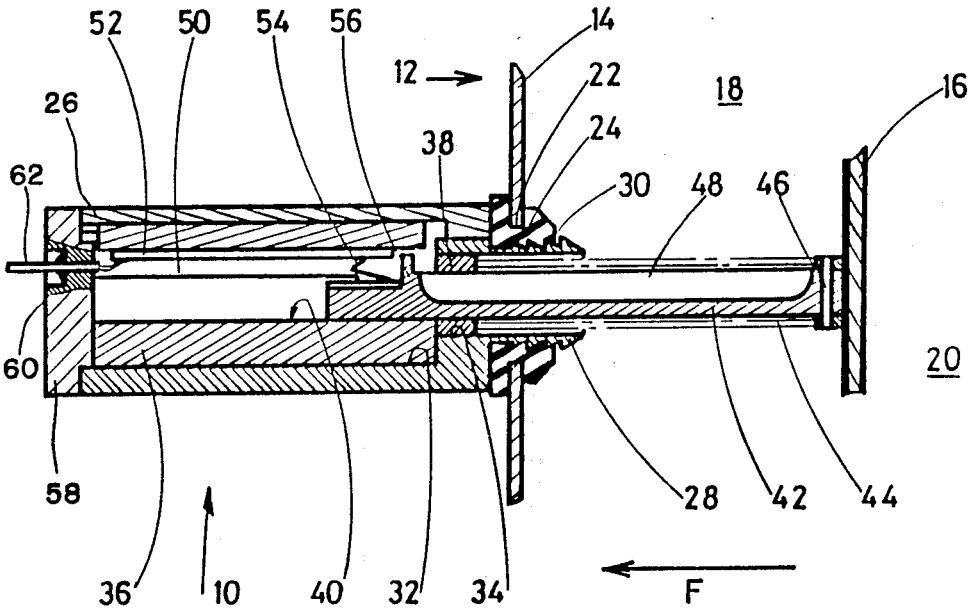
Figure 2:
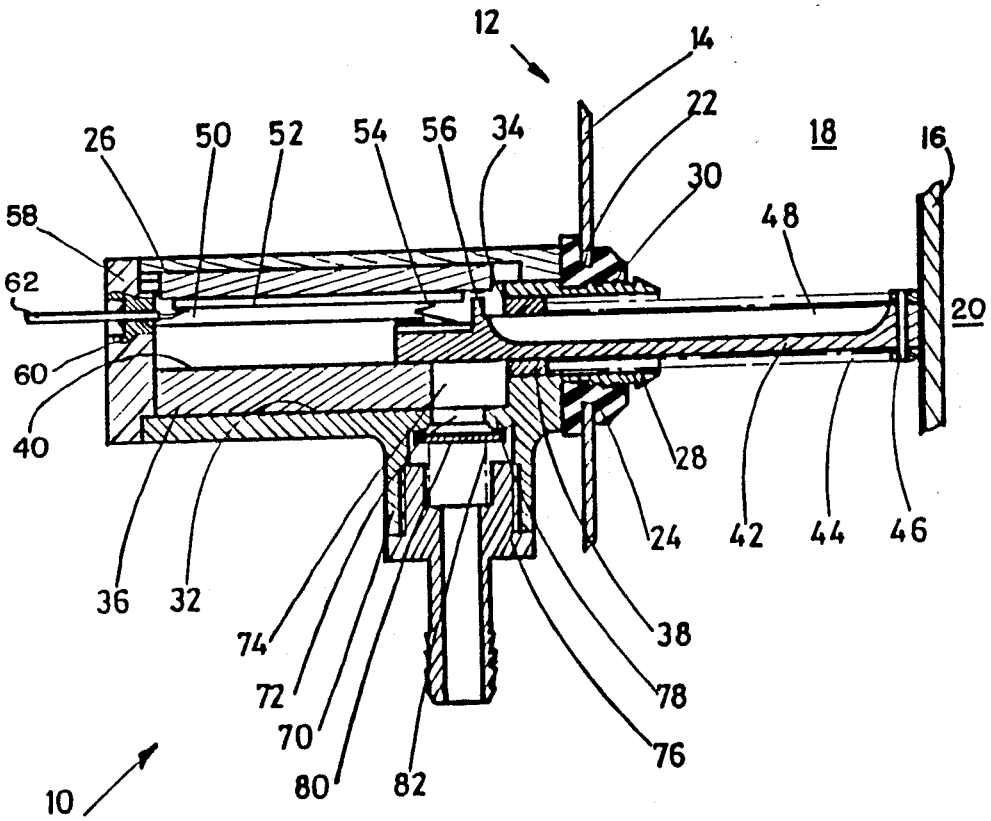
Figure 3:
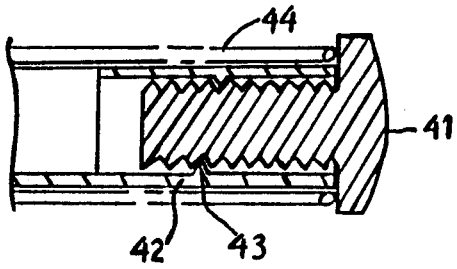

The invention will now be described by way of example with reference to the accompanying drawings in which:

FIG. 1 shows a longitudinal section through a detection device according to a first embodiment of the invention, FIG. 2 shows a similar view of a second embodiment of the invention, FIG. 3 shows an adjustment means that may be included in the detection device.

FIG. 1 shows, in section, a detection device 10 according to a first embodiment of the invention, fastened to a booster 12. This booster consists in a known way of a housing 14 divided internally by a piston means 16 into two selectively intercommunicating chambers 18 and 20. The housing 14 has an orifice 22, into which the detection device 10 is inserted sealingly by means of an elastic gasket 24.

The detection device 10 consists mainly of a body 26 of electrically conductive material and of cylindrical shape, and separate from the top portion of body 26 a part 28 of reduced diameter of which is equipped with annular grooves 30 on its periphery, the part 28 being designed to engage sealingly into the gasket 24, the grooves 30 forming in a known way a system for retaining the device 10 in the gasket 24.

The body 26 is equipped with a bore 32, into which opens another bore 34 of smaller diameter, made in the part 28 of reduced diameter. An electrically insulating sleeve 36 is introduced into the bore 32, and an electrically conductive ring 38 is introduced into the bore 34 and is of the same inside diameter as the sleeve 36, in order to define a continuous bore 40.

A rod 42 made of electrically conductive material slides in the bore 40 formed by the succession of bores made in the sleeve 36 and the ring 38 and extends outside the part 28 and therefore inside the chamber 18 up to the piston means 16. The rod 42 is kept in contact with the piston means 16 by a spring 44 bearing, on one side, on the ring 38, and on the other side, on a shoulder 46 formed at the end of the rod 42. This rod has longitudinal channels 48 putting the chamber 18 and the interior of the bore 40 in communication with one another.

Formed in the sleeve 36 is a longitudinal channel 50, on the bottom of which is laid an electrically conductive and resistive track 52, such as those used in linear potentiometers. That end of the rod 42 penetrating into the bore 40 carries an elastic metal tongue 54 designed to rub on the track 52, so as to form a movable contact between the rod 42 and the track 52. The rod 42 also possesses, in the vicinity of the tongue 54, a finger 56 which penetrates into the channel 50 and which serves both for immobilizing the rod 42 in terms of rotation relative to the sleeve 36 and for forming a stop preventing the rod 42 from coming out of the bore 40 under the effect of the spring 44.

Finally, the body 26 is closed sealingly, at its end opposite that fastened to the housing 14, by means of a plug 58 equipped with a passage 60 for a conductive wire 62 connected electrically to the nearest end of the track 52. The wire 62, track, 52, and tongue 54 comprise electrical circuit means of the device 10.

Thus, during the functioning of the booster 12, that is to say when the piston means 16 moves, for example in the direction of the arrow F, the rod 42 moves at the same time as the piston means 16 because of the spring 44 always keeping the rod laid against the piston at one of the rod ends. The other end consequently moves the elastic tongue 54 on the track 52. The electrical circuit formed by the wire 62, the track 52, the tongue 54, the rod 42, the ring 38 and the body 26 therefore has an electrical resistance variable as a function of the position of the piston means 16 because of the potentiometric track 52. A suitable electronic circuit connected to the terminals of this variable resistor will therefore supply a signal representing the position of the piston means 16 inside the booster housing, and this signal can be used to control other devices or for signalling purposes.

In order to mount the detection device just described, it is necessary to make an orifice in the booster housing and therefore use a gasket. Increasing the number of orifices in a pneumatic device proportionately increases the risk of leaks which can cause deterioration or even the complete stopping of the functioning of the pneumatic device.

Consequently, according to a preferred embodiment of the invention illustrated in FIG. 2, the device for detecting the position of the piston means is mounted in one of the orifices already made in the booster housing and necessary for its functioning. These orifices are connected, on one side of the booster, to the intake of air at atmospheric pressure and, on the other side, to a vacuum source.

FIG. 2 therefore shows a device for detecting the position of the piston means of a booster, similar to that of FIG. 1 and where the same elements are designated by the same mechanical references.

The body 26 of the device 10 is equipped laterally with a hollow extension 70. An orifice 72 is made in the body 26 in order to put the interior of the bore 32 in communication with the interior of the extension 70, the sleeve 36 itself also having an orifice 74 allowing communication between the interior of the bore 40 and the interior of the extension 70. A hollow connector 76 making connection to a pneumatic line (not shown) can be fastened on the extension 70. If this pneumatic line is connected to a vacuum source, there is generally provision for inserting a non-return valve ensuring that a reduced pressure is maintained in the chamber 18 during inoperative periods. Such a valve can advantageously be incorporated in the detection device 10, and the orifice 72 constituting a first valve means by means of its edges 78 forms the seat of a second valve means 80 kept in the rest position by means of a restoring spring 82 bearing at its other end on the connector 76.

In each of these embodiments, it is possible to provide a system for the automatic adjustment of the length of the rod 42, in order to allow for the play attributable to the production tolerances of the booster, that is to say the variations in distance at rest between the piston means 16 and the housing 14. The adjustment means may comprise a screw 41 received in a threading 43 of the rod 42 as illustrated in FIG. 3.

It can thus be seen that the invention provides a means of knowing the position of the piston means in a booster at any moment, without any modification of the latter, and can therefore be used for any type of existing booster.

It is clear that the invention can have numerous alternative versions, without departing from its spirit. Thus, the body of the device can be produced from a molded plastic, the electrical contacts being formed by sealed wire ducts. Likewise, if it is sufficient to detect only a few discrete positions of the piston means, the device of the invention and the associated electronic circuit can be simplified. It will be possible, for example, for the track 52 to be discontinuous, that is to say formed by conductive studs located at suitable distances corresponding to the positions to be detected, each stud being connected to an external electrical contact and therefore giving all-or-nothing information on the passage of the piston means through a predetermined position, for example the start of the stroke, an intermediate position and the end of the stroke. In this case, the end of the rod penetrating into the bore 40 can be equipped with a permanent magnet, while flexible-blade switches will be embedded at various locations in the body 26 or the sleeve 36 and actuated as a result of the passage of the permanent magnet level with them. It is also possible to provide a winding or solenoid coaxially relative to the bore 40, the rod 42 then functioning as a plunger core and changing the inductance of the winding which can be measured at its terminals. It will also be possible to produce the rod 42 from dielectric material and arrange two conductive plates in the body 26, so as to form a capicitor, the capitance of which will be a function of the position of the rod.

Finally, the invention can be used with any type of booster for brake and clutch boosting, whether single or in tandem. For a brake booster, it will be possible, for example, for the start-of-stroke contact to actuate brake warning lights ("stop" lights), for one or more intermediate-position contacts to act on a wheel antilock system, and for the end-of-stroke contact to signal excessive wear of the brake linings.

We claim:

1. A device for measuring electrically the position of a movable member relative to a stationary member, the stationary member being a wall of a booster housing and the movable member being piston means dividing the housing into a front chamber and a rear chamber, comprising movable first means which is movable together with the movable member and the movement of which is detected in relation to stationary second means that is stationary relative to the stationary member, wherein the stationary second means is connected with the stationary member outside of the booster housing and on a side the same as the front chamber, the stationary second means including electrical circuit means, and the movable first means sliding relative to the stationary second means and affecting the circuit means to vary operation of the electrical circuit means as a function of position of the movable, first means relative to the stationary second means, the stationary second means including a non-return valve and communicating about the movable first means with the front chamber, the non-return valve permitting one-way flow of medium relative to the front chamber.

2. The device according to claim 1, wherein the movable first means and the circuit means form a potentiometer.

3. The device according to claim 2, wherein the potentiometer is linear.

4. The device according to claim 1, including means for adjusting the length of the movable first means.

* * * * *